US011585601B2

(12) United States Patent
Olszewski

(10) Patent No.: US 11,585,601 B2
(45) Date of Patent: Feb. 21, 2023

(54) FLAMELESS IMPINGEMENT OVEN

(71) Applicant: WiSys Technology Foundation, Inc., Madison, WI (US)

(72) Inventor: Pawel Olszewski, Oshkosh, WI (US)

(73) Assignee: WISYS TECHNOLOGY FOUNDATION, INC., Madison, WI (US)

( * ) Notice: Subject to any disclaimer, the term of this patent is extended or adjusted under 35 U.S.C. 154(b) by 49 days.

(21) Appl. No.: 17/261,112

(22) PCT Filed: Aug. 5, 2019

(86) PCT No.: PCT/US2019/045127
§ 371 (c)(1),
(2) Date: Jan. 18, 2021

(87) PCT Pub. No.: WO2020/028904
PCT Pub. Date: Feb. 6, 2020

(65) Prior Publication Data

US 2021/0318068 A1 Oct. 14, 2021

Related U.S. Application Data

(60) Provisional application No. 62/714,537, filed on Aug. 3, 2018.

(51) Int. Cl.
*F27D 7/02* (2006.01)
*F27B 17/00* (2006.01)
*F27D 99/00* (2010.01)

(52) U.S. Cl.
CPC ..... *F27D 7/02* (2013.01); *F27B 17/0016* (2013.01); *F27D 99/0033* (2013.01)

(58) Field of Classification Search
None
See application file for complete search history.

(56) References Cited

U.S. PATENT DOCUMENTS

| | | | | |
|---|---|---|---|---|
| 5,154,599 | A * | 10/1992 | Wunning | F23B 90/06 431/9 |
| 7,029,271 | B2 * | 4/2006 | Wunning | F23L 15/02 126/91 A |
| 2007/0122756 | A1 * | 5/2007 | Wunning | F23D 91/02 431/11 |
| 2012/0152936 | A1 | 6/2012 | Claesson et al. | |
| 2019/0290063 | A1 * | 9/2019 | Shei | A47J 37/045 |

FOREIGN PATENT DOCUMENTS

| | | | | |
|---|---|---|---|---|
| JP | 2009180392 | A | 8/2009 | |
| JP | 5172333 | B2 | 3/2013 | |
| KR | 20010108367 | A | 12/2001 | |
| WO | WO-2017009020 | A1 * | 1/2017 | F27B 9/12 |

* cited by examiner

*Primary Examiner* — Steven S Anderson, II
*Assistant Examiner* — Kurt J Wolford
(74) *Attorney, Agent, or Firm* — Boyle Fredrickson, S.C.

(57) ABSTRACT

A flameless combustion oven arranges gas and air jets to directly impinge on the product being heated to substantially promote transfer of heat to the product by impingement transfer rather than by conventional radiation and thermally induced convection. In one embodiment, a set of spaced air and gas nozzles are uniformly distributed on a wall of the oven opposite the product to provide substantially uniform impingement over a surface of the product.

14 Claims, 3 Drawing Sheets

FLAMELESS IMPINGEMENT OVEN

CROSS REFERENCE TO RELATED APPLICATION

This application claims the benefit of U.S. provisional application 62/714,537 filed Aug. 3, 2018, and hereby incorporated in its entirety by reference.

STATEMENT REGARDING FEDERALLY SPONSORED RESEARCH OR DEVELOPMENT

BACKGROUND OF THE INVENTION

The present invention relates generally to industrial ovens or furnaces for use in heating materials and in particular to an improved flameless combustion oven.

Industrial ovens are used for a wide range of heating applications including but not limited to heat treating and melting materials. Such ovens may provide an insulated compartment providing a volume heated by one or more burners mixing air and a fuel (for example, natural gas) to provide for a flame directly or indirectly heating the air of the volume. The flame produced by such burners provides a highly variable combustion environment defined in part by a flame front producing high temperatures believed to promote the formation of nitrous oxide pollutants.

It is known that combustion can occur without a flame. Such combustion is termed "flameless" combustion and is described, for example, in U.S. Pat. No. 5,154,599 hereby incorporated by reference. In flameless combustion, combustion is distributed throughout the oven compartment largely eliminating temperature spikes and substantially decreasing formation of nitrous oxide pollutants. Flameless combustion can provide more uniform temperature distribution and permit operation with a wider variety of fuels because flame stability is not required among other benefits.

In such flameless combustion ovens, one or more conventional burners may be positioned to direct mixed fuel and air into the oven cavity which may be ignited in the manner of a conventional burner. Heat from the combustion is used to preheat the air and gas which may be further adjusted to achieve the condition of flameless combustion.

SUMMARY OF THE INVENTION

The present inventor has recognized that the heat transfer from flameless combustion to a product being heated is limited by the indirect heat transfer pathway. This pathway requires convection heating of the oven walls until a point where those walls produce substantial radiative heating of the product. This heating of the walls is energy consuming and can promote heat loss as well as refractory degradation.

The present invention accordingly uses "impingement" style flameless combustion in which gas and air jets providing the flameless combustion gases, are directed toward the product being heated. Even though the combustion is largely distributed outside of the stream of these jets, it is believed that this approach substantially increases heat transfer rate between the combustion gases over general turbulent flow. Directing the air and gas jets directly against the product being heated is counterintuitive in the case where there are no flames and where combustion is widely distributed both in and outside of these jets. Intentional formation of impinging jets also appears to be inconsistent with more turbulent conditions of mixing exhaust fuel and air plausibly necessary for flameless combustion.

More specifically, in one embodiment, the invention provides a flameless impingement oven having an oven cavity providing oven walls and a contained surface for supporting a product to be heated within the oven cavity. A regenerator receives heated air from passing out of the oven cavity through first channels and receives fuel passing into the oven cavity through second channels, the first channels and second channels adapted to provide heat conduction between the first and second channels to heat the fuel for flameless heating of the oven cavity. A plurality of fuel gas jets face into the oven cavity and are directed toward the surface, the plurality of fuel jets communicating with the second channels to receive gas therefrom. The fuel jets are arranged to distribute the fuel within the oven cavity to support flameless heating of the oven cavity and to direct fuel into direct impingement against a product on the surface for impingement heating.

It is thus a feature of at least one embodiment of the invention to provide the benefits of flameless heating while improving its heating efficiency through direct impingement of the fuel on the product.

The regenerator may further include third channels receiving air passing into the oven cavity through the third channels, the first and third channels adapted to provide heat conduction between the first and third channels to heat the air for flameless heating of the oven cavity. A plurality of air jets receive air from the third channels and face into the oven cavity to direct toward the surface. The air jets are arranged to distribute the air within the oven cavity to support flameless heating of the oven cavity and to direct air into direct impingement against a product on the surface for impingement heating.

It is thus a feature of another embodiment of the invention to provide direct impingement of separate air jets on the product.

The fuel jets and air jets may be interleaved in two directions over an area spaced from the surface.

It is thus a feature of at least one embodiment of the invention to provide a set of streams of separate gas and fuel to promote flameless combustion in conjunction with impingement on the product.

The air jets may be positioned at outermost locations of the interleaved fuel jets and air jets.

It is thus a feature of at least one embodiment of the invention to reduce heating of the walls in favor of the workpiece through the use of an outer air curtain.

The air jets and fuel jets may be uniformly distributed within a plane.

It is thus a feature of at least one embodiment of the invention to provide a versatile jet arrangement adaptable for a wide range of heating applications where the workpiece may have different shapes.

The fuel jets and air jets may be separated from the fuel jets by no less than one quarter of the separation between adjacent fuel jets.

It is thus a feature of at least one embodiment of the invention to provide a set of airstreams that are approximately uniform in impinging on the product.

At least 25% of the air exiting the air jets and at least 25% of the fuel exiting the fuel jets may strike the product on the surface before striking a wall of the oven.

It is thus a feature of at least one embodiment of the invention to promote direct impingement which is believed to substantially increase heat transfer.

During flameless heating, the air and fuel directly impinging on a product are at least partially reacted with each other.

It is thus a feature of at least one embodiment of the invention to provide impinging streams undergoing combustion that can transfer their heat of combustion directly to the product.

The surface may be a lower wall of the oven and the fuel may be directed downwardly.

It is thus a feature of at least one embodiment of the invention to provide a versatile configuration in an oven for both solid products that can rest on a rack on a lower surface and liquid products supported in a cauldron or the like.

The first, second, and third channels are contained within a common housing defining the third channels.

It is thus a feature of at least one embodiment of the invention to provide a simple regenerator that surrounds the first and second channels with exhausted hot air.

The oven may further include a control system controlling air and gas flow to produce flameless heating.

It is thus a feature of at least one embodiment of the invention to provide a well-defined environment suitable for automated feedback control.

The nozzles may have varying opening diameters to promote uniform heating of the product by impingement.

It is thus a feature of at least one embodiment of the invention to tailor the impingement for even heating in an environment where impingement heating dominates.

The invention may implement a method where product is primarily heated by impingement transfer rather than by convection or radiation.

It is thus a feature of at least one embodiment of the invention to greatly increase the heating efficiency of an oven using flameless combustion.

These particular objects and advantages may apply to only some embodiments falling within the claims and thus do not define the scope of the invention.

DETAILED DESCRIPTION OF THE PREFERRED EMBODIMENT

Figure 1:
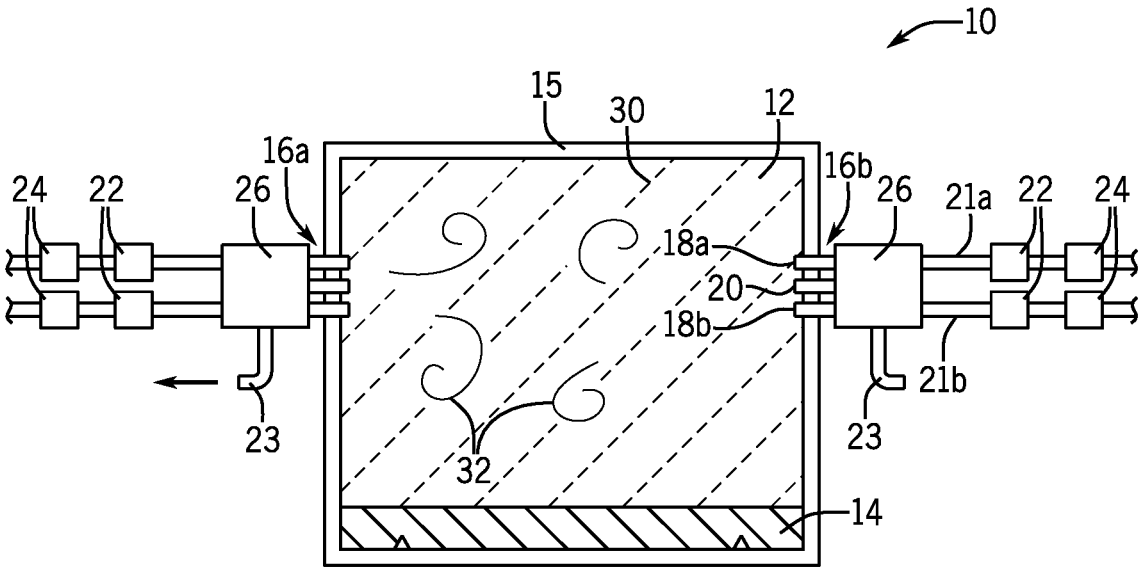
FIG. 1 PRIOR ART
FIG. 1 is a simplified diagram of a conventional flameless oven showing sidewall mounted burners producing turbulent mixing of fuel, air, and heated exhaust.

Referring now to FIG. 1, a prior art flameless oven 10 may provide for a generally insulated oven cavity 12, for example, constructed of enclosing top, side, and bottom walls 15 of firebrick or similar refractory material. A product 14 for heating by the oven 10 is positioned, for example, at the bottom of the oven cavity 12 supported on a rack or container, for example, in a cauldron for liquefied materials or on a stand for solid materials or on a conveyor belt.

Burner assemblies 16*a* and 16*b* may pass through opposite side walls 15, for example, each directed toward a center of the oven cavity 12. Each burner assembly 16 may provide multiple jets 18, including air jets 18*a* and gas jets 18*b*, for introducing air and fuel, respectively, into the oven cavity 12 from pressurize sources of air and fuel (not shown). The burner assemblies 16 may also provide an exhaust port 20 for receiving heated exhaust gases from the oven cavity 12 for regenerative heating of the air and gas.

The air and gas may be controlled by a flow sensor 22 and may be pressure regulated by pressure sensors/regulators 24 positioned on air line 21*a* and gas line 21*b*, respectively, to provide proper stochiometric combustion and to promote flameless combustion. An igniter (not shown) may be used to initiate combustion. Thermocouples and other sensors, including reactive species sensors, may be coupled to the oven cavity 12 and may communicate measurement signals with a computer (not shown), the latter controlling valves to automatically initiate and stabilize flameless combustion according to techniques generally understood to those of ordinary skill in the art by control of the air and gas.

The exhaust port 20 associated with each burner assembly 16 may conduct heated gases from the oven cavity 12 to a regenerator 26 which serves to heat the air and fuel prior to combustion in the oven cavity 12. After passing through the regenerator 26, the heated combustion gases exit through a low-temperature exhaust outlet 23. Generally, the direction of introduction of air and fuel is arbitrary with uniform heating provided by distributed combustion 30 (indicated by the dotted lines) within the oven cavity 12 from reacting gases 32 (air and fuel gas such as natural gas) dispersed in a highly turbulent manner for improved mixing.

Figure 2:
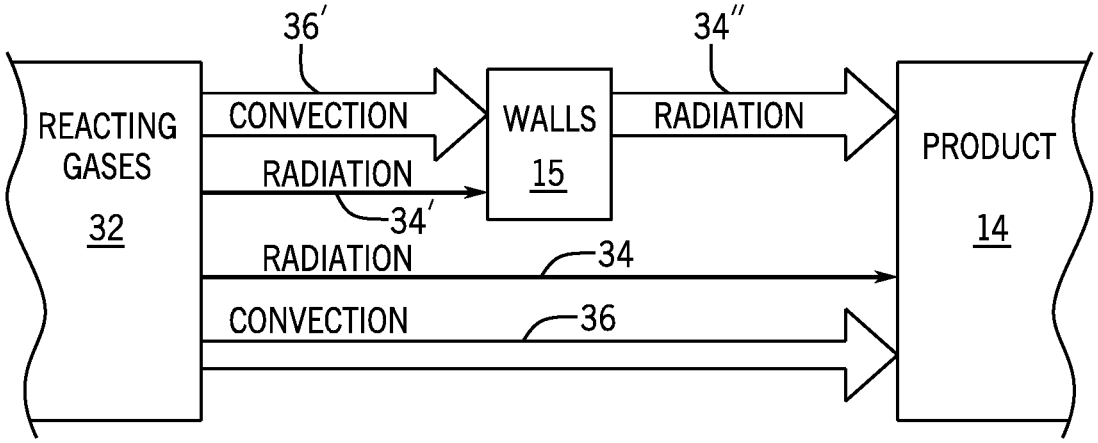
FIG. 2 PRIOR ART
FIG. 2 is an energy flow diagram showing the energy pathways identified by the present inventor in the conventional flameless oven of FIG. 1.

Referring to FIG. 2, the flameless combustion produced by the prior art flameless combustion oven 10 provides relatively low radiation transfer 34 from the reacting gases 32 to the product 14, illustrated by a thin arrow whose width suggests the heat transfer rate. Slightly more heat is delivered by thermally induced convection transfer 36 directly to the product 14. Primarily heat is delivered from the reacting gases 32 to the product 14 indirectly by thermally induced convection transfer 36' and radiation transfer 34' heating the walls 15 of the flameless combustion oven 10 which then provide a substantially greater radiation transfer 34" to the product 14 at a longer wavelength. Substantial inefficiencies are introduced by the need to heat the walls 15 both in consuming unnecessary energy in that heating and from increased heat loss through the limited thermal resistance of those walls 15.

Figure 3:
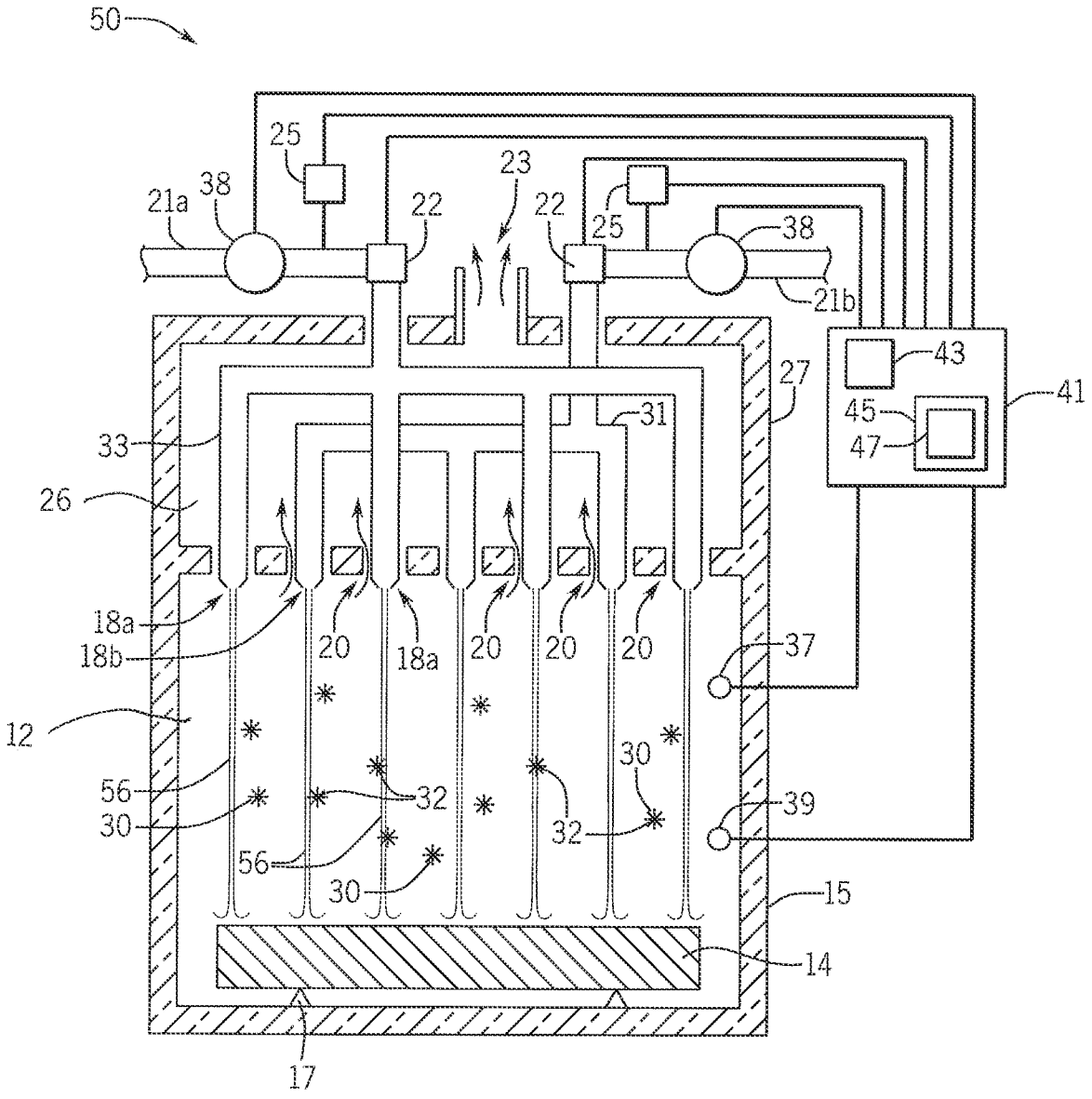
FIG. 3 is a diagram similar to FIG. 1 of an impingement flameless oven of the present invention in cross-section showing directed air and fuel jets producing streams impinging on the product being heated and showing countervailing exhaust exit points, the cross-section line modified to pass through both air jets and gas jets.

Referring now to FIG. 3, a flameless impingement oven 50 according to one embodiment of the present invention may provide an oven cavity 12 with heat resistant insulating walls 15 and a product 14, for example, placed on a support 17 or in a cauldron and positioned at a bottom of the oven cavity 12. The flameless impingement oven 50 includes the features of the flameless oven 10 described above except as now discussed.

In the flameless impingement oven 50, substantial changes are implemented in the jets 18*a* and 18*b*. First, they are attached to an upper wall 15 of the oven cavity 12 to face down producing downwardly directed jet streams 56 of air and gas impinging directly on the product 14. This impingement may be insured both by the geometry of the oven cavity 12, the placement of the jets 18, and the setting of the velocity flow rate of the gas and air flowing through the jets 18.

Figure 4:
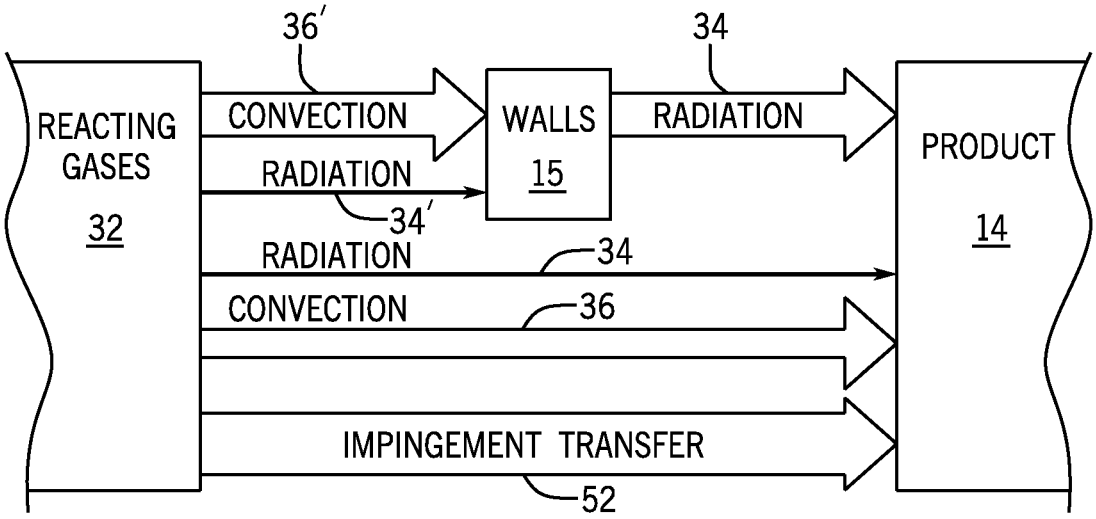
FIG. 4 is an energy flow diagram similar to FIG. 2 for the oven of FIG. 3.

Referring now also to FIG. 4, by providing direct impingement of air and fuel streams directly on the product 14, energy transfer to the product 14 from the reacting gases 32 is promoted by impingement transfer 52 being a forced convection mechanism where energy is carried by the mass of the heated gases whose movement is generated by an external source such as a pump pressuring the air and fuel and conducted directly from the gas to the product 14. The remaining transfer paths of normal thermally induced convection transfer 36 (being natural convection driven by gravitational forces acting on different densities of hot and cold gases) and radiation transfer 34 also exist but there will be less heating of the walls 15 by thermally induced convection transfer 36' because this energy will be preemptively transferred by impingement transfer 52.

Figure 5:
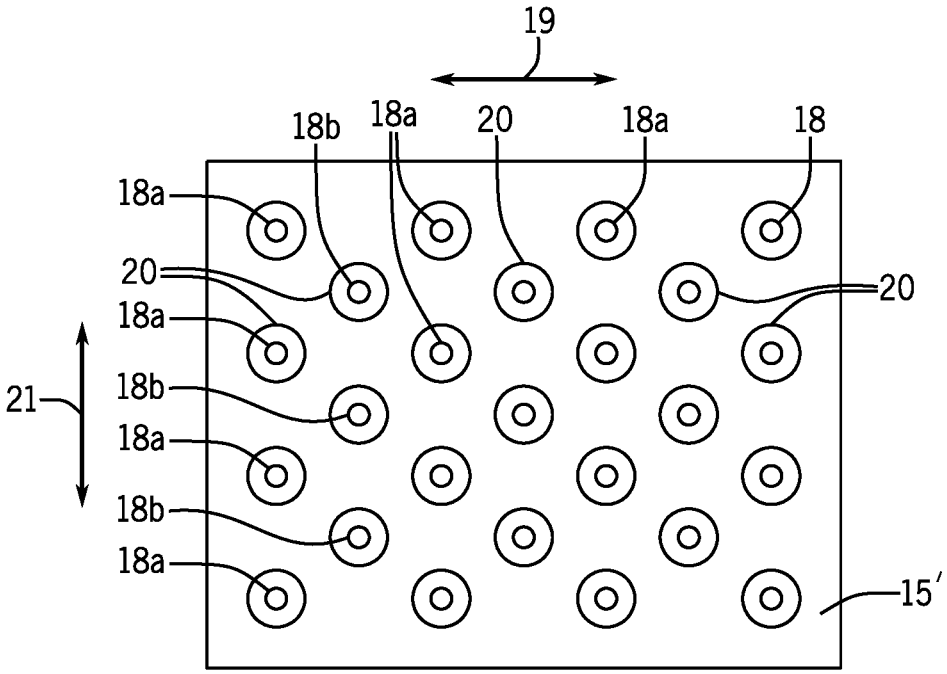
FIG. 5 is a bottom plan view of the upper wall of the oven of FIG. 3 showing a distribution of air, fuel, and exhaust ports.

Referring now to FIGS. 3 and 5, generally the individual air jets 18*a* will be substantially uniformly distributed over the upper wall 15' of the oven cavity 12. Likewise, the individual gas jets 18*b* will be uniformly distributed over the upper wall 15' of the oven cavity 12 and will be given uniform separation from surrounding air jets 18*a*. In one embodiment, the air jets 18*a* and gas jets 18*b* are distributed at the intersections of a rectangular grid aligned with the walls of the oven. In some embodiments the air jets 18 may occupy the outermost positions in the grid so, for example, to permit a 5×5 grid of air jets 18*a* with an interior 4×4 grid of gas jets 18*b* with each gas jets surrounded by four air jets 18*a*. Other combinations for example may include a 4×4 grid of air jets 18*a* interleaved with a 3×3 grid of gas jets or a 3×3 grid of air jets 18*a* with an interior 2×2 grid of gas jets 18*b*, etc. The exhaust ports 20 may be concentric holes positioned around the air jets 18*a* and gas jets 18*b* or may be separate openings in either case leading into the regenerator 27 (as will be discussed below) with an exit in a larger exhaust port 23. The gas jets 18*b* in one embodiment may be separated from the air jets 18*a* by a distance approximately half the separation distance between each of the air jets 18*a* along either width 19 or depth 21 with respect to other air jets 18*a* and the separation distance between each of the gas jets 18*b* in either width 19 or depth 21 from other gas jets 18*b* may be identical to the separation between the air jets 18*a* with the idea of providing a uniform but distributed set of jet streams 56 uniformly impinging on the product 14. Generally, the desire for uniform separation will provide that the separation in width 19 or depth 21 between a given air jet 18*a* and a given gas jet 18*b* will be no less than one quarter of the separation between adjacent gas jets 18*a* or adjacent air jets 18*a*, and that the variation between spacing of the given nozzle type (e.g., air jet 18*a* or gas jet 18*b*) will be uniform to within a range of 50 percent. In different embodiments, the separation between the adjacent air jets 18*a* or between adjacent fuel jets 18*b* may vary between three inches and six inches and the nozzle sizes of the air jets 18*a* and fuel jets 18*b* may vary between 1/16 of an inch and 1/8 of an inch. Generally, the nozzle sizes of the air jets 18*a* and fuel jets 18*b* need not be identical and within either the air jets 18*a* and/or the fuel jets 18*b* nozzle sizes may also vary.

Referring again to FIG. 3, each of the air jets 18*a* may be connected together by a manifold 33 within a housing 27 of the regenerator 26 providing countercurrent heat exchange (shown in simplified form) with combustion gases exiting through the exit ports 20. Likewise each of the gas jets 18*b* may connect together in a manifold 31 for heating by the exhaust gases in the regenerator 26 which receives heated gas into the housing 27 through the exhaust ports 20 and transfers that gas after heat exchange with the manifolds 33 and 31 with a low-temperature exhaust outlet 23 for venting into the atmosphere. It will be appreciated that the space between the manifolds 33 and 31 and the walls of the housing 27 provide an effective channel conducting heated gas from the oven cavity.

The air line 21*a* and gas line 21*b* may have pressure control and flow regulation using flow sensors 22 and pressure sensors 25 and control valve/regulators 38 as discussed above with respect to FIG. 1. The oven cavity may be monitored with temperature sensors 37 and reactive species sensors 39, for example, monitoring carbon monoxide and/or nitrous oxide. Electrical signals from the flow sensors 22, the pressure sensors 25, the temperature sensors 37, and the reactive species sensors 39 may communicate with a computer 41, and the computer 41 may provide signals to the control valve/regulators 38 to control air flow and gas flow. The computer 41 may include an electronic processor 43 executing a program 45 stored in electronic memory 47, for example, implementing a proportional/integral/derivative control algorithm to promote flameless combustion.

In addition to controlling the diameters of the jets 18, flow may be controlled using the control valve/regulators 38. In some embodiments, the nozzles of the air jets 18*a* and gas jets 18*b* are coplanar and that plane may be spaced from the product 14 by a range of 5 inches to 8 inches. Generally, the orientation of the jets 18 will be parallel and arranged to provide a return path for gases around the jet streams 56 to promote direct impingement.

While heating of a single side of the product 14 is shown, the invention contemplates that sets of jets may be directed toward different surfaces of the product 14, for example, from two sides of the product 14, for improved heating of some types of product 14.

Impingement occurs when at least 25 percent of the air or gas exiting an air jet 18*a* or gas jet 18*b* can be expected to strike the product 14 before striking a wall 15. The axis of the jets 18*a* and 18*b* is defined by the principal velocity of exiting gas or air. "Direct" with respect to direct impingement on a product means that gas exiting the jets strikes the product before contacting the oven wall. "Flameless combustion" means combustion without a visible flame front, typically in an air-gas mixture above the auto ignition temperature. With flameless combustion, homogenous combustion occurs within a majority of the oven cavity and there is an abrupt drop in carbon monoxide and nitrous oxide formation.

The invention is not limited to natural gas or even gaseous fuels and may also be used with liquid fuels, biogas, and other fuel types. It will further be appreciated that existing ovens can be retrofit to provide an impingement, flameless oven of the present invention through the addition of correctly positioned and configured nozzles, preheating of fuel and air, and control of the resulting combustion as taught herein.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

References to "a microprocessor" and "a processor" or "the microprocessor" and "the processor," can be understood to include one or more microprocessors that can communicate in a stand-alone and/or a distributed environment(s), and can thus be configured to communicate via wired or wireless communications with other processors, where such one or more processor can be configured to operate on one or more processor-controlled devices that can be similar or different devices. Furthermore, references to memory, unless otherwise specified, can include one or more processor-readable and accessible memory elements and/or components that can be internal to the processor-controlled device, external to the processor-controlled device, and can be accessed via a wired or wireless network.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

I claim:

1. A flameless impingement oven comprising:

an oven cavity providing oven walls and a contained surface for supporting a product to be heated within the oven cavity;

a regenerator receiving heated air passing out of the oven cavity through first channels and receiving fuel passing into the oven cavity through second channels, the first channels and second channels adapted to provide heat conduction directly between the first and second channels, without an intervening flow of fresh air, to heat the fuel for flameless heating of the oven cavity;

a plurality of fuel gas jets receiving fuel from the second channels and facing into the oven cavity to direct fuel toward the surface;

wherein the fuel jets are arranged to distribute the fuel within the oven cavity to support flameless heating of the oven cavity; and wherein the fuel jets are positioned to direct fuel into direct impingement against a product on the surface for impingement heating;

wherein the regenerator further includes third channels receiving the fresh air passing into the oven cavity through the third channels, the first and third channels adapted to provide heat conduction directly between the first and third channels, without an intervening flow of fuel, to heat the air for flameless heating of the oven cavity; and further including a plurality of air jets receiving fresh air from the third channels to direct the fresh air toward the surface;

wherein the air jets are spaced from the fuel jets to distribute the fresh air within the oven cavity to support flameless heating of the oven cavity so that a separation between any given air jet and a given gas jet will be no less than one quarter of the separation between adjacent gas jets or adjacent air jets; and wherein the air jets are positioned to direct fresh air into direct impingement against a product on the surface for impingement heating.

2. The flameless impingement oven of claim 1 wherein the fuel jets and air jets are interleaved in two directions over an area spaced from the surface.

3. The flameless impingement oven of claim 2 wherein the air jets are positioned at outermost locations in the interleaved fuel jets and air jets.

4. The flameless impingement oven of claim 2 wherein the outlets of the air jets and fuel jets are uniformly distributed within a plane.

5. The flameless impingement oven of claim 1 wherein at least 25% of the air exiting the air jets and at least 25% of the fuel exiting the fuel jets strikes a product on the surface before striking a wall of the oven.

6. The flameless impingement oven of claim 1 wherein during flameless heating the air and fuel directly impinging on a product are at least partially reacted with each other.

7. The flameless impingement oven of claim 1 wherein the surface is a lower wall of the oven and the fuel is directed downwardly.

8. The flameless impingement oven of claim 1 wherein the first, second, and third channels are contained within a common housing defining the three channels.

9. The flameless impingement oven of claim 1 further including a control system controlling air and gas flow to produce flameless heating.

10. The flameless impingement oven of claim 1 wherein the fuel is selected from the group consisting of gaseous fuels and liquid fuels that gasify on introduction into the oven.

11. The flameless impingement oven of claim 1 wherein the air jets and gas jets have varying opening diameters to promote uniform heating of the product by impingement.

12. The flameless impingement oven of claim 1 wherein the variation between spacing of the air jets and gas jets is uniform to within a range of 50 percent.

13. A method of heating a product in an oven cavity, the method providing:

positioning the product in an oven cavity;

receiving fuel through a regenerator at multiple fuel jets positioned in the oven cavity to direct fuel into direct impingement on the product;

receiving outside air through the regenerator at multiple air jets positioned in the oven cavity to direct air into direct impingement on the product wherein the air jets are spaced from the fuel jets so that a separation between any given air jet and a given gas jet will be no less than one quarter of the separation between adjacent gas jets or adjacent air jets; and receiving heated air from the oven cavity through the regenerator to conduct heat from the heated air to the outside air before it passes to the air jets and from the heated air to the fuel before it passes to the fuel jets wherein the conduction of heat from the heated air to the outside air occurs directly without intervening flow of fuel and wherein the conduction of heat from the heated air to the fuel occurs directly without intervening flow of outside air;

controlling the fuel and air to promote flameless combustion in the oven cavity while preserving the direct impingement of the air and fuel.

14. The method of claim 13 wherein the product is primarily heated by impingement transfer rather than convection or radiation.

* * * * *